US005454325A

United States Patent [19]

LeBlanc

[11] Patent Number: 5,454,325

[45] Date of Patent: Oct. 3, 1995

[54] SMALL ARMS AMMUNITION BULLET

[75] Inventor: Russell P. LeBlanc, Nova Scotia, Canada

[73] Assignee: Beeline Custom Bullets Limited, Nova Scotia, Canada

[21] Appl. No.: 323,952

[22] Filed: Oct. 17, 1994

Related U.S. Application Data

[63] Continuation-in-part of Ser. No. 144,585, Sep. 20, 1993, abandoned.

[51] Int. Cl.[6] ..... F42B 12/02

[52] U.S. Cl. ..... 102/506; 102/516; 102/517

[58] Field of Search ..... 102/494–496, 102/439, 460, 501, 506–510, 514–518; 29/1.23

[56] References Cited

U.S. PATENT DOCUMENTS

| | | | |
|---|---|---|---|
| 3,059,578 | 10/1962 | Hegge et al. | 102/89 |
| 3,208,386 | 9/1965 | Schneider et al. | 102/506 |
| 3,400,660 | 9/1968 | Malter | 102/42 |
| 3,720,170 | 3/1973 | Godfrey | 102/516 |
| 3,972,286 | 8/1976 | Canon | 102/38 |
| 4,353,305 | 10/1982 | Moreau | 102/519 |
| 4,714,023 | 12/1987 | Brown | 102/516 |
| 5,101,732 | 4/1992 | Schluckebier | 102/509 |
| 5,160,805 | 11/1992 | Winter | 102/518 |

FOREIGN PATENT DOCUMENTS

| | | | |
|---|---|---|---|
| 191539 | 10/1907 | Germany . | |
| 3345618 | 6/1985 | Germany . | |
| 2003032 | 11/1993 | Russian Federation | 102/509 |

OTHER PUBLICATIONS

Handgun Stopping Power: The Definitive Study, by Evan P. Marshall and Edwin J. Sanow pp. 117, 119, 120, 171, 179, 180, 1992.

Handguns for Sport and Defense, vol. 6, No. 5, May 1992, Best Defense Loads for the .44 Magnum, by Duane Thomas, pp. 67, 68, 81.

*Primary Examiner*—Harold J. Tudor

*Attorney, Agent, or Firm*—Townsend and Townsend and Crew

[57] ABSTRACT

A small arm ammunition bullet has a metal jacket with a first core portion of thermoplastic material filling a closed end of the interior of the jacket and a second core portion projecting through an opposite, open end of the jacket. The second core portion is formed of a plurality of individual metal fragments compacted into an at least substantially solid mass. The bullet is made by swaging lead shot and the thermoplastic material into the jacket and combines good expansion on impact with a soft target with the ability to penetrate a hard target.

11 Claims, 5 Drawing Sheets

SMALL ARMS AMMUNITION BULLET

CROSS-REFERENCE TO RELATED APPLICATION

This is a continuation-in-part of Ser. No. 08/144,585, filed Sep. 20, 1993, now abandoned.

BACKGROUND OF THE INVENTION

1. Field of the Invention

The present invention relates to bullets for use in small arms ammunition and, in particular, to so-called pre-fragmented bullets comprising a jacket containing individual metal pieces.

2. Description of the Related Art

It has previous been proposed to provide a pre-fragmented bullet comprising a copper jacket filled with bird shot, which is intended to rupture on impact so as to create a wound resembling a scaled-down shotgun wound.

One advantage of this prior bullet is that it produces massive tissue damage as deeply as the slug penetrates. This prior bullet also has the advantage that it does not over-penetrate its primary target. In other words, the bullet does not penetrate a target sufficiently with enough energy to exit from the target, with the risk of hitting an unintended secondary target. Further, the prior bullet is so fragile it bursts upon angular impact against a hard surface and, therefore, does not ricochet. In addition, this prior bullet is less likely than any other bullet to penetrate walls, for example, in a domestic scenario so as to endanger people in adjacent rooms or at the exterior of a building within which the bullet is fired.

However, it is also a disadvantage of this prior bullet that it produces only shallow tissue penetration and, therefore, may not sufficiently penetrate in side-to-side shots, shots involving intermediate targets such as upper arms and other shots calling for deep penetration. Also, the prior bullet is readily fragmented by impact against, for example, car glass, car metal or building materials, which a felon is likely to use for cover. Unlike a solid bullet, this prior bullet cannot be caused to bounce or ricochet under, for example, an automobile body so as to hit a felon behind the automobile body.

BRIEF SUMMARY OF THE INVENTION

It is accordingly on object of the present invention to provide a novel and improved bullet which acts as a pre-fragmented projectile but which also is capable of penetrating hard obstacles.

According to the present invention, there is provided a small arms ammunition bullet having a jacket with a hollow interior having an open end and a closed end. A first core portion of thermoplastic material is provided within the hollow interior at the closed end. A second core portion projects through the open end and is formed by individual metal fragments compacted into an at least substantially solid mass.

On impact against, for example, water, ballistic gelatin or living tissue, this bullet releases its energy quickly, so that the jacket is upset and the individual fragments separate from one another and spread apart from the main path of the bullet. However, this bullet is also capable of penetrating hard obstacles when required.

By compaction of the individual fragments into a solid mass, the presence of voids within the jacket is avoided and the bullet is therefore more stable when fired and, thus, more accurate.

The thermoplastic material fills the space within the jacket between the compacted fragment mass and the closed end of the jacket, and lightens the bullet, thus further improving the ballistics of the bullet.

The bullet is manufactured by inserting the thermoplastic material into the hollow interior at the closed end thereof, and then inserting individual pieces of metal onto the plastic material in the hollow interior. By use of, for example, a swaging die, the thermoplastic material and the metal pieces are compacted in the hollow interior so that the thermoplastic material fills the closed end of the hollow interior and the metal pieces are compacted together into a substantially solid mass. A further metal piece is then positioned on the solid mass at the open end of the hollow interior of the jacket and is compacted against the mass as a part thereof projecting through the open end, the jacket being collapsed at the open end onto the further metal piece to form a nose therewith.

BRIEF DESCRIPTION OF THE DRAWINGS

Further objects, advantages and features of the present invention will be more readily apparent from the following description thereof when taken in conjunction with the accompanying drawings, in which.

DESCRIPTION OF THE PREFERRED EMBODIMENTS

Figure 1:
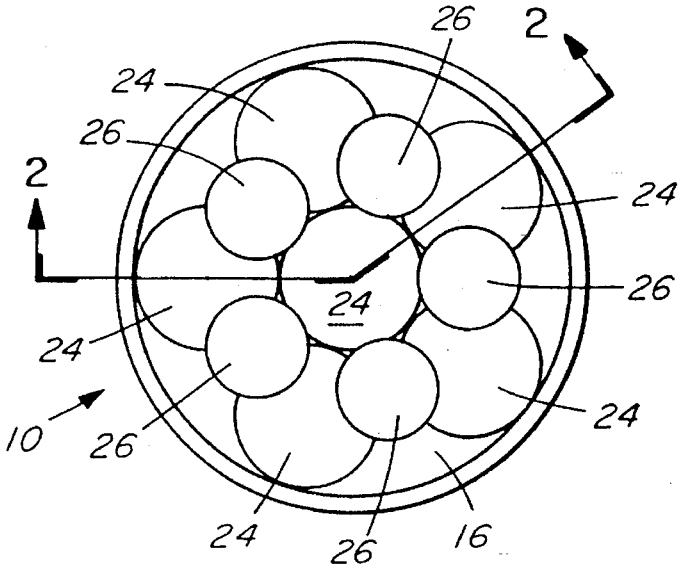
FIG. 1 shows a plan view of components of a bullet during a first stage of the manufacture thereof.
Figure 2:
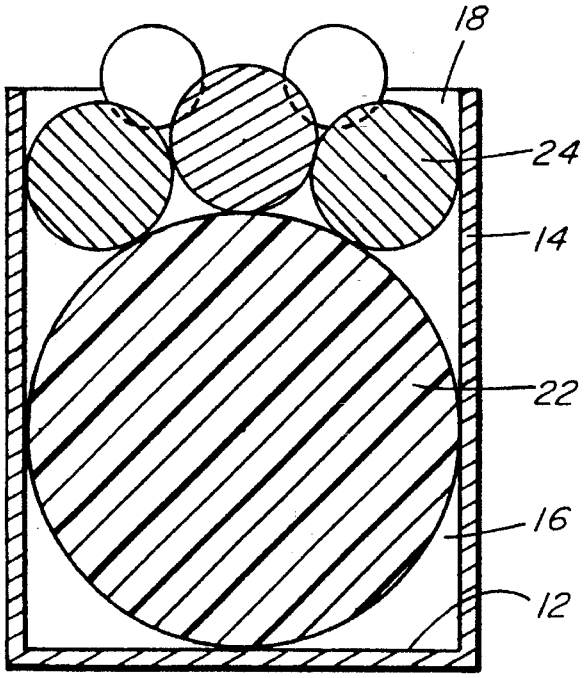
FIG. 2 shows a view taken in cross-section along the line 2—2 of FIG. 1.

Referring firstly to FIG. 1 and 2 of the accompanying drawings, reference numeral 10 indicates generally a metal jacket which comprises a circular base 12 and a cylindrical wall 14 upstanding from the base 12. The jacket 10 has a hollow interior 16, which has one end closed by the jacket base 12, and an open end 18 opposite from the closed end.

The jacket 10, in the present embodiment of the invention, is made of copper. However it is alternatively possible to substitute a copper alloy, aluminum, an aluminum alloy or gilding metal instead of copper.

In the manufacture of a bullet employing the jacket 10, a ball or sphere 22 of polyethylene is inserted into the closed end of the jacket. However, other thermoplastic materials may, if desired, be substituted for polyethylene. Six #6 lead bird shot 24 are then placed on top of the thermoplastic ball 20 within the jacket hollow interior 16 in a side-by-side arrangement. As can be seen from FIG. 1, the shot 24 are arranged with a single shot 24 at the centre of the array, and with the remaining five shot 24 evenly spaced around this central shot 24.

Next, five #9 shot 26 are arranged in an equally-spaced array, with each of the shot 26 resting on three of the underlying shot 24.

Figure 3:
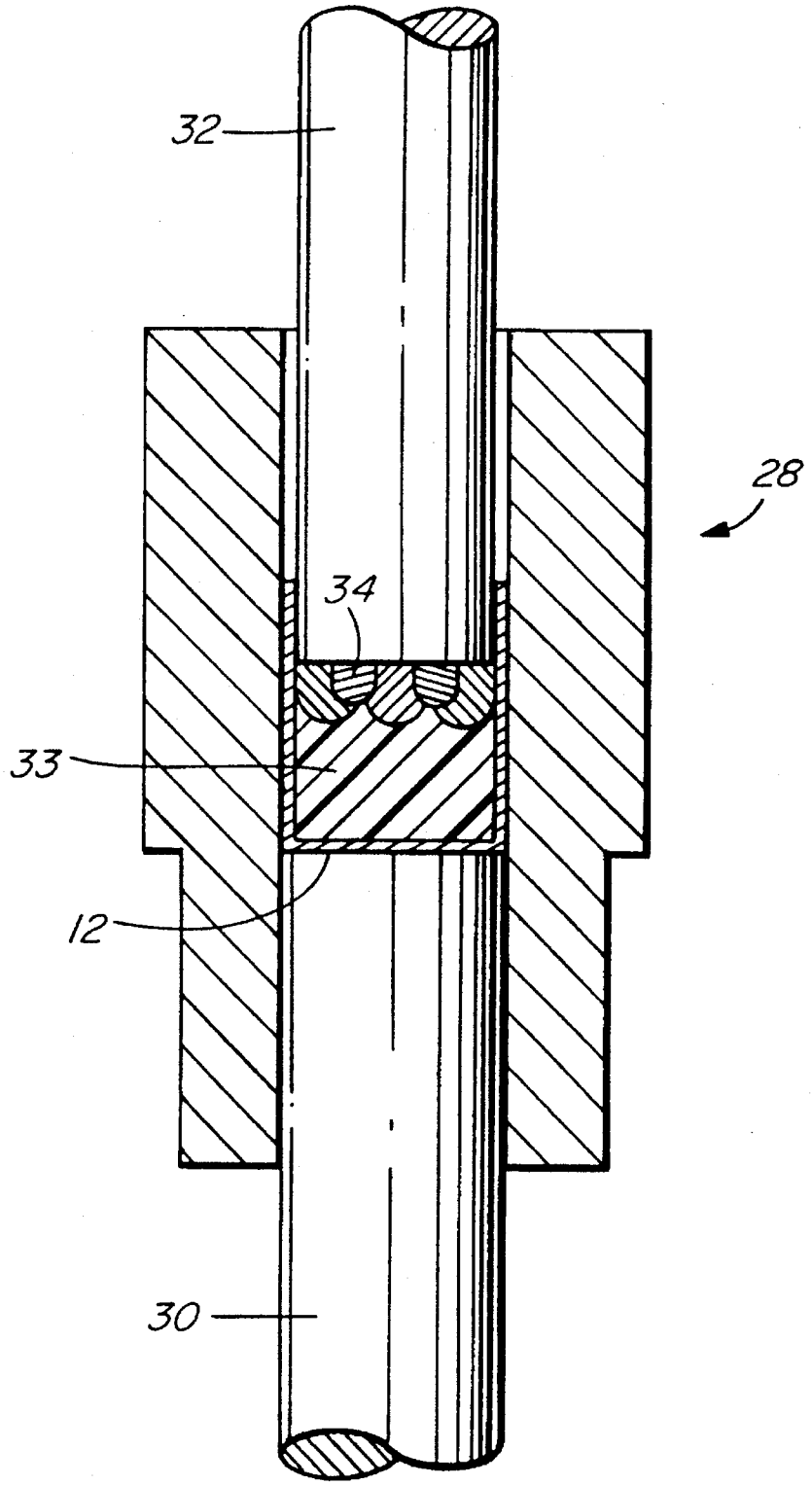
FIG. 3 shows a view taken in cross-section through a swaging die during compaction of some of the components shown in FIGS. 1 and 2.

The thermoplastic ball 20 and the shot 24 and 26 are then compacted in a swaging die indicated generally by reference numeral 28 in FIG. 3. The swaging die 28 is provided with a cylindrical support 30, which abuts the base 12 of the jacket 10 and which has a diameter substantially equal to that of the jacket 10. A punch 32, having a diameter substantially equal to the interior diameter of the jacket 10, is then displaced downwardly against the shot 24 and 26. In this way the thermoplastic ball 20 is deformed into a first core portion in the form of a mass 33 which fills the closed lower end 60 of the jacket 10. Simultaneously the shot 24 and 26 are compacted together to form a second core portion in the form of a substantially solid mass indicated by reference numeral 34 in FIG. 3. The mass 33 fills the hollow interior of the jacket 10 from the closed end to the mass 34.

In this connection, it is pointed out that the shot 24 and 26 should be arranged in the above-described equally-spaced manner, rather than being simply dropped in a random manner into the jacket 10, in order to avoid the formation of voids in the compacted mass 34 during the swaging operation and, thereby, to avoid impairing the accuracy of the finished bullet in use.

Also, by arranging the shot 24 and 26 in the above-described equally spaced manner, dispersion of the corresponding fragments of the bullet around the main bullet track, on impact of the bullet, is ensured, thus increasing the chances of striking a vital organ or blood vessel that would not have been struck by a similar impact of a non-pre-fragmented bullet.

By the use of swaging to compact the shot 24 and 26, as described, so as to avoid the formation of voids in the compacted metal mass, the stability of the finished bullet when fired, and thus its accuracy, are enhanced. Also, the swaging of the lead shot deforms the shot into a flattened somewhat disk-like shape which increases the damage caused by penetration of the finished bullet into tissue as compared to conventional round shot. Further, the risk of over-penetration of a target is likewise reduced.

Figure 4:
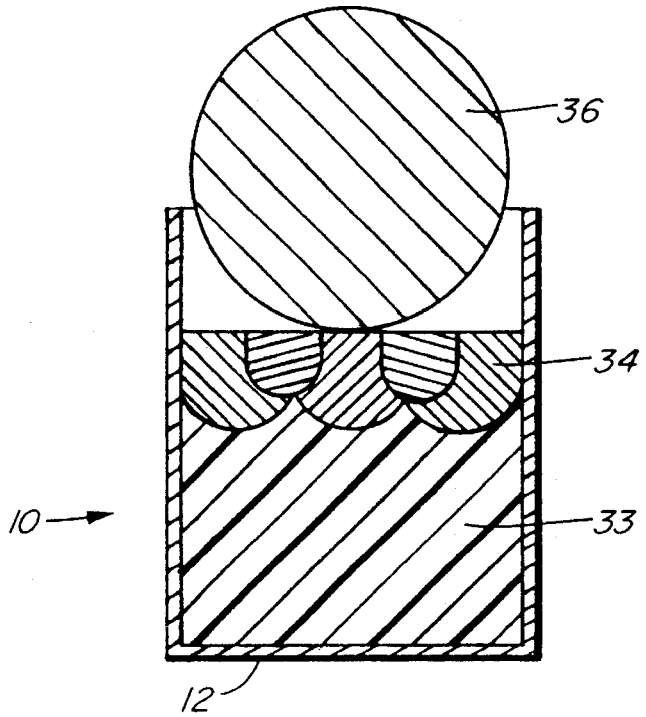
FIG. 4 shows a view in vertical cross-section through the bullet components of FIGS. 1 and 2 during a subsequent step in the manufacture of the bullet.

Following the above-described swaging operation, a #4 Bk. shot 36 is placed centrally on top of the swaged mass 34 as shown in FIG. 4. The shot 36 and the upper, open end of the jacket 10 are then swaged in a nose-forming die (not shown) to form a nose indicated generally by reference numeral 38 in FIG. 5, the nose 38 having a generally ogive shape with a flat circular tip end 39.

Figure 5:
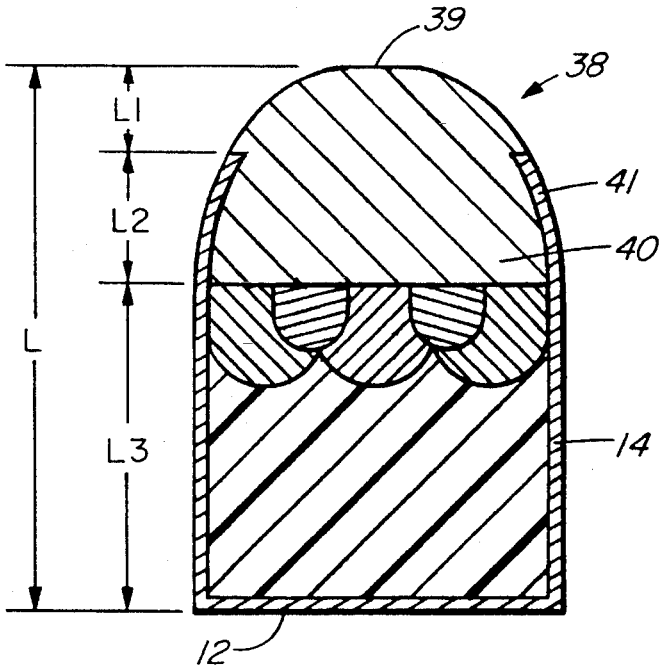
FIG. 5 shows a view taken in vertical cross-section through the finished bullet.

The nose 38 of the finished bullet 5, as shown in FIG. 5, thus forms a tapered tip, with the shot 36 of FIG. 4 deformed to constitute, together with the solid mass 34, a larger solid mass 40 projecting through the upper, open end of the jacket 10, and an upper portion 41 of the jacket wall 14 being collapsed inwardly to penetrate the solid mass 40, as shown.

It has been found by experiment that the jacket 10 should advantageously have a wall thickness of 0.017 inch when the jacket 10 is made of copper or gilding metal and 0.021 inch when the jacket 10 is made of aluminum. More particularly, a thickness greater than this will cause some deterioration of the performance of the bullet when it impacts gelatin, i.e. the bullet will not expand optimally and, therefore, may over-penetrate, whereas if the jacket wall thickness is less than this dimension the bullet may not provide optimum penetration of obstacles.

This wall thickness may extend from the base to the top of the jacket 10. However, the jacket may alternatively be tapered in its wall thickness, provided that the thickness of the jacket has the above dimension from the open end of the jacket over one third of the total length of the jacket.

The total length L of the bullet in the present embodiment is 0.528 inch, the nose 42 projects by a distance L1=0.074 inch beyond the jacket 10 and the tapered wall 41 extends over a distance of L2=0.119 inch, cylindrical portion of the wall 14 extending over a distance L3=0.335 inch. Also, the circular tip end 39 of the nose 42 has a diameter D=0.080 inch, the finished bullet having a diameter 0.355 inch.

Figure 6:
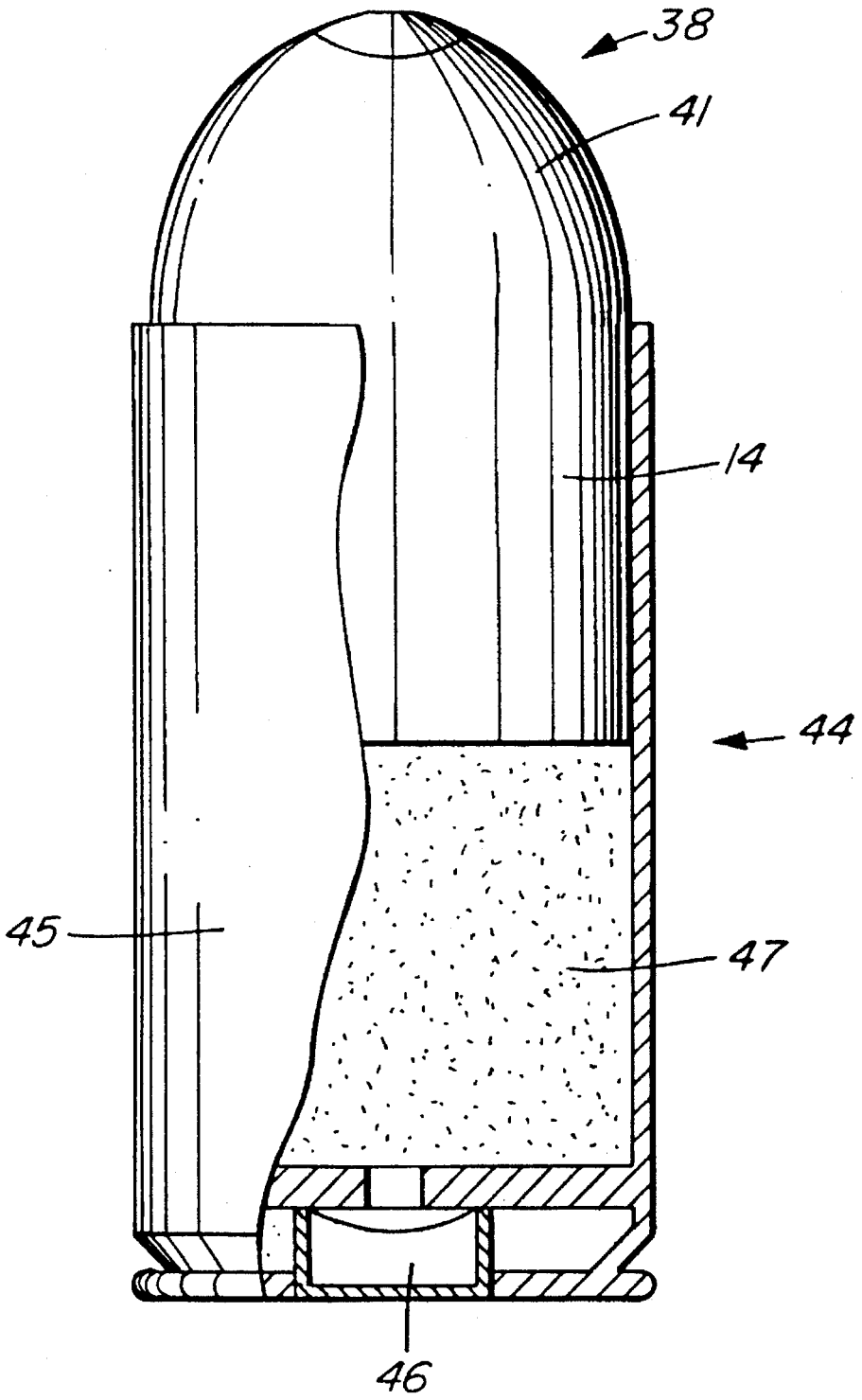
FIG. 6 shows a view in vertical cross-section through a round of ammunition including the bullet of FIG. 5.

FIG. 6 shows the bullet in a complete ammunition round indicated generally by reference numeral 44, which includes a brass cartridge 45, a detonator 46 and a propellant 47.

Figure 7:
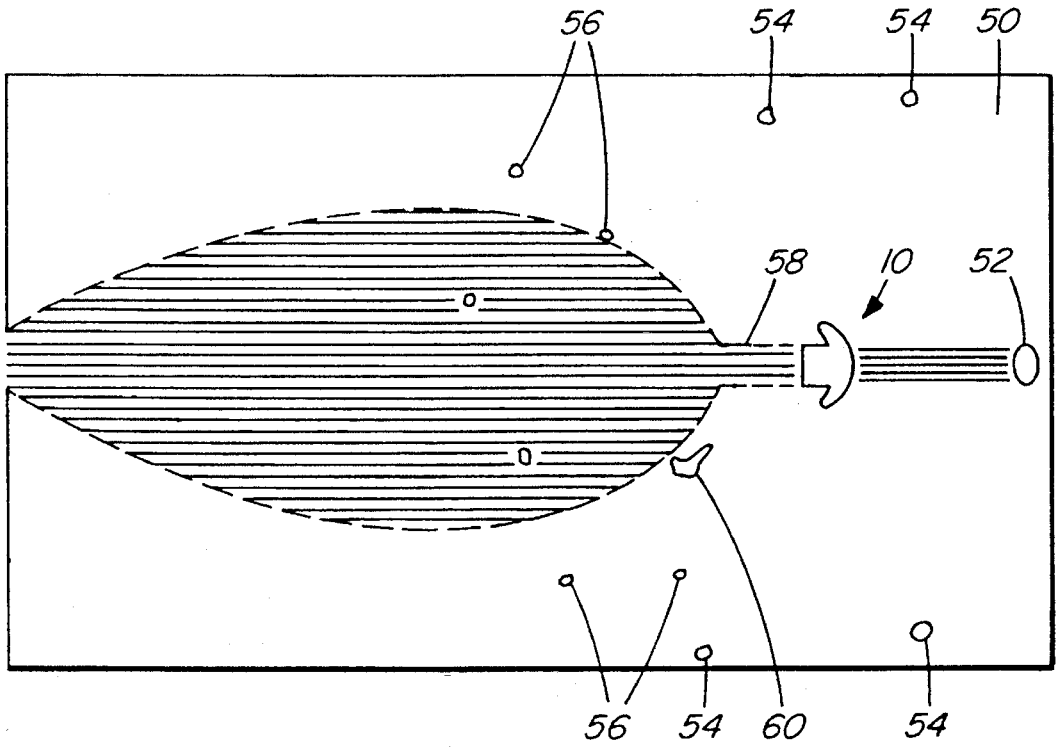
FIG. 7 shows a diagram illustrating the penetration of the bullet of FIG. 5 into ballistic gelatin.

FIG. 7 diagrammatically illustrates penetration of the bullet when fired into a block of 10% 250A ballistic gelatin 50 having a length of ten inches. The bullet has fragmented into a first fragment 52 formed by the nose 42 of the bullet, the jacket 10 being expanded and located behind the fragment 52, and further fragments 54 and 56, formed from the shot 24 and 26, respectively, being scattered along tracks extending at about 45° from the main bullet path, indicated by reference numeral 58. Occasionally, metal fragments 60 are spun off from the jacket 10.

It is to be understood that the size of the lead shot may vary, depending upon the calibre of the bullet. Generally #5, #6, #9 and BB lead shot are well suited for the manufacture of bullets, while #4 Bk. shot is well suited to form the nose of the bullet.

The thermoplastic material employed for the ball 20 serves to lighten the bullet. By lightening the bullet, the velocity of the bullet when fired is increased and, in this way, the velocity can be maintained sufficiently high to ensure that the bullet fragments, and spreads apart the metal jacket, upon impact. When this happens, the swaged shot come apart at about 45° to the main bullet path 58 as shown in FIG. 7, around the main bullet path 58.

As will be apparent to those skilled in the art, the shot size and the diameter of the plastic ball 20 will vary, depending upon the calibre of the bullet, and also the number of shot employed may vary.

Thus, for example, in the case of a 0.44 calibre bullet, BB shot and a #4 Bk. shot may be employed, whereas a 0.45 calibre bullet, #5 shot, #12 shot and #4 Bk. shot may be employed.

The #4 Bk. shot (hard or regular) is heavy enough to provide sufficient weight at the front of the bullet and, after being formed with a ¾ inch ogive shape in a swaging die, as described, the bullet will have a suitable profile for reliable feeding in both fully automatic and semi-automatic weapons.

Also, instead of employing lead shot, it is alternatively possible to substitute bismuth shot.

As will be apparent to those skilled in the art, various other modifications may be made in the above described embodiments of the invention within the scope of the appended claims.

I claim:

1. A small arms ammunition bullet, comprising:

a metal jacket having a hollow interior with a closed end and a tapered open end;

a first core portion of thermoplastic material within said hollow interior;

a second core portion within said hollow interior and spaced from said closed end of said jacket;

said second core portion comprising a plurality of individual metal projectiles evenly distributed across said hollow interior and compacted into an at least substantially solid mass;

said first core portion filling said hollow interior from said closed end of said jacket to said second core portion; and a metal nose compacted against said second core portion and forming part of said solid mass, said metal nose projecting through said open end of said jacket.

2. A small arms ammunition bullet as claimed in claim 1, wherein said metal projectiles comprise compacted shot.

3. A small arms ammunition bullet as claimed in claim 1, wherein said nose comprises a single piece of compacted shot.

4. A small arms ammunition bullet as claimed in claim 1, wherein said metal projectiles and said nose comprise metal selected from the group consisting of lead and bismuth.

5. A small arms ammunition bullet as claimed in claim 1, wherein said jacket comprises a metal selected from the group consisting of copper and gilding metal and has a wall thickness of 0.017 inch over at least one third of the length of said jacket from said open end thereof.

6. A small arms ammunition bullet as claimed in claim 1, wherein said jacket comprises aluminium and has a wall thickness of 0.021 inch over at least one third of the length of said jacket from said open end thereof.

7. A small arms ammunition bullet as claimed in claim b, wherein said projectiles comprise a first group of projectiles compacted against said first core portion and a second group of projectiles compacted against said first group, said projectiles of said first group being larger than said projectiles of said second group.

8. A small arms ammunition bullet, comprising:

a metal jacket having a hollow interior with a closed end and a tapered open end;

a first core portion of thermoplastic material within said hollow interior;

a second core portion within said hollow interior and spaced from said closed end of said jacket;

said second core portion comprising a plurality of individual metal shot evenly distributed across said hollow interior of said jacket and compacted into an at least substantially solid mass;

said first core portion filling said hollow interior from said closed end of said jacket to said second core portion;

said shot comprising a first group of shot compacted against said first core portion and a second group of shot compacted against said first group, said shot of said first group being larger than said shot of said second group; and a metal nose comprising a single piece of shot compacted against said second core portion and forming part of said solid mass, said metal nose projecting through said open end of said jacket.

9. A small arms ammunition bullet as claimed in claim 8, wherein said shot comprises metal selected from the group consisting of lead and bismuth.

10. A small arms ammunition bullet as claimed in claim 8, wherein said jacket comprises a metal selected from the group consisting of copper and gilding metal and has a wall thickness of 0.017 inch over at least one third of the length of said jacket from said open end thereof.

11. A small arms ammunition bullet as claimed in claim 8, wherein said jacket comprises aluminium and has a wall thickness of 0.021 inch over at least one third of the length of said jacket from said open end thereof.

* * * * *